US007627467B2

(12) United States Patent
Florencio et al.

(10) Patent No.: US 7,627,467 B2
(45) Date of Patent: Dec. 1, 2009

(54) PACKET LOSS CONCEALMENT FOR OVERLAPPED TRANSFORM CODECS

(75) Inventors: Dinei A. Florencio, Redmond, WA (US); Philip A. Chou, Bellevue, WA (US)

(73) Assignee: Microsoft Corporation, Redmond, WA (US)

( * ) Notice: Subject to any disclaimer, the term of this patent is extended or adjusted under 35 U.S.C. 154(b) by 943 days.

(21) Appl. No.: 11/173,017

(22) Filed: Jun. 30, 2005

(65) Prior Publication Data

US 2006/0209955 A1 Sep. 21, 2006

Related U.S. Application Data

(60) Provisional application No. 60/657,831, filed on Mar. 1, 2005.

(51) Int. Cl.
*G10L 11/00* (2006.01)

(52) U.S. Cl. ..... 704/202; 704/200; 704/201; 704/203; 704/219

(58) Field of Classification Search ..... 704/202, 704/200, 201, 203, 219
See application file for complete search history.

(56) References Cited

U.S. PATENT DOCUMENTS 7,356,748 B2 * 4/2008 Taleb ..... 714/746
2002/0007273 A1 * 1/2002 Chen ..... 704/229
2004/0039464 A1 * 2/2004 Virolainen et al. ..... 700/94

OTHER PUBLICATIONS

Y. J. Liang, N. Färber, and B. Girod, "Adaptive playout scheduling and loss concealment for voice communication over IP networks," *IEEE Transactions on Multimedia*, vol. 5, No. 4, pp. 532-543, Dec. 2003.
R. Ramjee, J. Kurose and D. Towsley, 'Adaptive playout mechanisms for packetized audio applications in wide-area networks,' Proc. of INFOCOM'94, vol. 2, pp. 680-688, Jun. 1994.
C. Perkins, O. Hodson, and V. Hardman, "A survey of packet-loss recovery techniques for streaming audio," IEEE Network Magazine, Sep./Oct. 1998.

* cited by examiner

*Primary Examiner*—Qi Han
(74) *Attorney, Agent, or Firm*—Lyon & Harr, LLP; Mark A. Watson

(57) ABSTRACT

Real-time packet-based audio communications over packet-based networks frequently results in the loss of one or more packets during any given communication session. The real-time nature of such communications precludes retransmission of lost packets due to the unacceptable delays that would result. Consequently, packet loss concealment methods are employed to "hide" lost packets from the listener. Unfortunately, conventional loss concealment methods, such as packet repetition or stretch/overlap methods, do not fully exploit information available from partially received samples. Therefore, when a single frame of N coefficients is lost, 2N samples are only partially reconstructed, thereby degrading the reconstructed signal. To address this problem, an optimized packet loss concealment solution is identified for particular lost packets by solving an underdetermined system of linear equations representing partially received samples while minimizing a computed error based on a model of the signal obtained from neighboring blocks or frames received by the decoder.

20 Claims, 3 Drawing Sheets

PACKET LOSS CONCEALMENT FOR OVERLAPPED TRANSFORM CODECS

CROSS REFERENCE TO RELATED APPLICATIONS

This application claims the benefit under Title 35, U.S. Code, Section 119(e), of a previously filed U.S. Provisional Patent Application, Ser. No. 60/657,831 filed on Mar. 1, 2005, by Florencio, et al., and entitled "PACKET LOSS CONCEALMENT FOR OVERLAPPED TRANSFORM CODECS.

BACKGROUND

1. Technical Field

The invention is related to receipt and playback of packet-based audio signals, and in particular, to a system and method for providing improved packet loss concealment for overlapped transform encoded signals broadcast across a packet-based network or communications channel.

2. Related Art

Conventional packet communication systems, such as the Internet or other broadcast networks, are typically lossy. In other words, not every transmitted packet can be guaranteed to be delivered either error free, on time, or even in the correct sequence. Further, any delay in delivery time is usually variable. If the receiver can wait for packets to be retransmitted, correctly ordered, or corrected using some type of error correction scheme, then the fact that such networks are inherently lossy and delay prone is not an issue. However, for near real-time applications, such as, for example, voice-based communications systems across packet-based networks, the receiver can not wait for packets to be retransmitted, correctly ordered, or corrected without causing undue, and noticeable, lag or delay in the communication.

Many conventional schemes address minor delays in packet delivery time by simply providing a temporary buffer of received packets in combination with a delayed playback of the received packets. Such schemes are often referred to as "jitter control" schemes. In general, most such schemes address delay in packet receipt by using a "jitter buffer" or the like which temporarily stores incoming packets or signal frames and provides them to a decoder with sufficient delay that one or more subsequent packets should have already been received. In other words, the jitter buffer simply keeps one or more packets in a buffer for delaying playback of the incoming signal for a period long enough to ensure that a majority of packets are actually received before they need to be played.

A sufficient increase in the length of the buffer allows virtually all packets to be received before they need to be played back. In fact, if the size of the jitter buffer is at least as long as the difference between the smallest and largest possible packet delays, then all packets could be played without any apparent gap or delay between packets. Unfortunately, as the length of the buffer increases, playback of the signal increasingly lags real-time. In a one-way audio signal, such as a music broadcast, for example, this is typically not a problem. However, in systems such as real-time or two-way conversations, temporal lag resulting from the use of such buffers becomes increasing apparent, and undesirable, as the buffer length increases.

In addition, the basic idea of using a buffer has been improved in many modern communications systems by using compression and stretching techniques for providing temporal adjustment of the playback duration of signal frames. As a result, the jitter buffer length can be adapted during speech utterances by stretching or compressing the currently playing audio signal, as necessary, for reducing the average delay without incurring as many late losses. Unfortunately, the use of temporal stretching and compression techniques for frames in an audio signal often results in audible artifacts which may be objectionable to the human listener.

Consequently, an additional conventional technique, commonly referred to as "packet loss concealment," has been used to further improve the perceived speech quality in the presence of lost or overly delayed packets. As noted above, packet loss may occur when overly delayed packets are not received in time for playback. Typically, such overly delayed packets are referred to as "late loss" packets. Similarly, packet loss may also occur simply because the packet was never received. Either way, conventional packet loss concealment schemes typically address overly delayed and lost packets in the same manner by using some sort of packet loss concealment technique. In general, packet loss concealment techniques operate to conceal or hide the fact that a packet that should be played has not been received. In addition, packet loss concealment techniques are frequently used in combination with the aforementioned jitter control techniques.

In general, with packet loss concealment techniques, when a packet does not arrive by the scheduled time, it is declared to be a late loss, and error concealment is then used to hide that loss. Most modern schemes use some form of stretching and compression in combination with a windowing technique for merging boundaries of packets bordering missing packets declared to be late loss packets. In general, such schemes typically operate by decomposing input packets into overlapping segments of equal length. These overlapping segments are then realigned and superimposed via a conventional correlation process along with smoothing of the overlap regions to form an output segment having a degree of overlap which results in the desired output length. The result is that the composite segment is useful for hiding or concealing perceived packet delay or loss. Unfortunately, in the case of overlapped transform coders, the composite signal segments generated by conventional packet loss concealment techniques fail to fully exploit the partial information available from partially received neighboring samples (i.e., packets on either or both sides of a lost data packet).

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

As described herein, an "adaptive packet loss concealer" is provided for maximizing the quality of recovered signals as a function of received neighboring data packets. Further, the packet loss concealment techniques described herein are fully adaptable for use in combination with conventional jitter control and other signal buffering techniques. Note that jitter control techniques, and their operation in combination with packet loss concealment techniques, are well known to those skilled in the art, and will not be described in detail herein. Further, the packet loss concealment techniques described herein are adaptable for use with essentially any linear transform where some of the coefficients are missing. Important cases include missing "frames" of overlapped transform (e.g., MLT), or wavelets, or even single or multiple missing transform coefficients within a block produced by a block transform (e.g., DCT). However, for purposes of explanation, the discussion of the packet loss concealer provided herein will focus on the case of overlapped transforms.

Overlapped transform coders, such as transforms with fixed length basis (e.g., modulated lapped transforms (MLT's)), and transforms having variable length basis (e.g., wavelets) are used in numerous codecs, including audio (MP3, WMA), speech (ITU-G722.1), image (JPEG2000), and also in some video codecs. As is well known to those skilled in the art, the overlapping blocks of an overlapped transform coded signal contain partial information about neighboring blocks as a result of the use of overlapping sampling windows. Consequently, the coded blocks of a received data packet will contain partial information regarding the coded blocks in each immediately neighboring packet (preceding and succeeding). The packet loss concealer described herein uses this partial information in determining adaptive solutions for concealing missing or lost blocks in applications such as, for example, real time audio communication over packet networks.

Typically, packets are declared as being lost in a real-time, or near real-time, system when they are not received within a predetermined window of time. Note that this window of time may be variable depending upon whether jitter control or other buffered playback techniques are also being used in combination with the packet loss concealment methods described herein. In any case, once it is determined that loss concealment should be used to hide a particular lost packet, the packet loss concealer described herein operates to reconstruct optimized signal segments for concealing the lost packets.

In general, the adaptive packet loss concealer operates to "hide" lost packets from the listener by exploiting information available from partially received samples to reconstruct missing signal segments. The adaptive packet loss concealer provides this capability by determining an optimized packet loss concealment solution for particular lost packets. This optimized solution is found by solving an underdetermined system of linear equations representing partially received samples while minimizing a computed error based on a model of the signal obtained from neighboring blocks or frames received by the decoder.

In particular, as is known to those skilled in the art, when coding a signal using 2-times overlapped transforms, the signal is split into overlapping blocks of 2N samples. Then, for each block, N transform coefficients are obtained via a multiply/accumulate process with the basis functions constituting the transform. On the decoder side, the basis functions are scaled by the transform coefficients, to reconstruct "partial" blocks of 2N samples each. These blocks of samples are then overlap/added to reconstruct the original signal for playback, or other use, as desired.

However, if the information about any one of the blocks of N coefficients is lost, a total of 2N samples—spanning the lost coefficients—cannot be reconstructed. If the lost coefficients are replaced with zeros, a non-zero, but incorrect reconstructed signal, can be generated. This zeroing technique has been used with some conventional packet loss concealment techniques. Unfortunately, the result is typically that there are noticeable artifacts in the reconstructed signal.

In order to address this problem, the adaptive packet loss concealer makes use of the observation that overlapped transforms, such as conventional modulated lapped transforms (MLT), are critically sampled. Therefore, some partial information is available in immediately neighboring blocks about the 2N incomplete samples resulting from a lost block of N coefficients. The adaptive packet loss concealer first uses this partial information to construct an energy-based model of the surrounding components of the signal. Next, the adaptive packet loss concealer operates to construct a total of N linear equations from neighboring blocks for describing the 2N incomplete samples. These N linear equations represent an undetermined system of equations (N equations and 2N variables).

The adaptive packet loss concealer then operates to find and choose an optimal solution to this underdetermined system of equations by finding a solution, among all possible solutions, that minimizes a model-based energy criterion relative to the constructed energy-based model of the surrounding signal. Finally, the lost block of N coefficients is reconstructed using the energy-based optimal solution. These coefficients are then decoded and provided for playback to hide the loss of the original coefficients. Further, it should be noted that as a result of the windowing used in obtaining the original coefficients when encoding the original signal, the ends of the reconstructed signal segment will align exactly with the ends of the adjoining signal segments that were successfully received by the system. Consequently, additional smoothing or alignment of the reconstructed signal is not necessary.

In view of the above summary, it is clear that in at least one embodiment, the adaptive packet loss concealer described herein provides a unique system and method for generating optimized signal segments for hiding lost data packets so as to minimize perceivable artifacts in the reconstruction of an encoded signal. In addition to the just described benefits, other advantages of the system and method for providing adaptive packet loss concealment for a received signal will become apparent from the detailed description which follows hereinafter when taken in conjunction with the accompanying drawing figures.

DESCRIPTION OF THE DRAWINGS

The specific features, aspects, and advantages of the present invention will become better understood with regard to the following description, appended claims, and accompanying drawings where:

DETAILED DESCRIPTION

In the following detailed description, reference is made to the accompanying drawings, which form a part hereof, and in which is shown by way of illustration specific embodiments in which the invention may be practiced. It is understood that other embodiments may be utilized and structural changes may be made without departing from the scope of the present invention.

Figure 1:
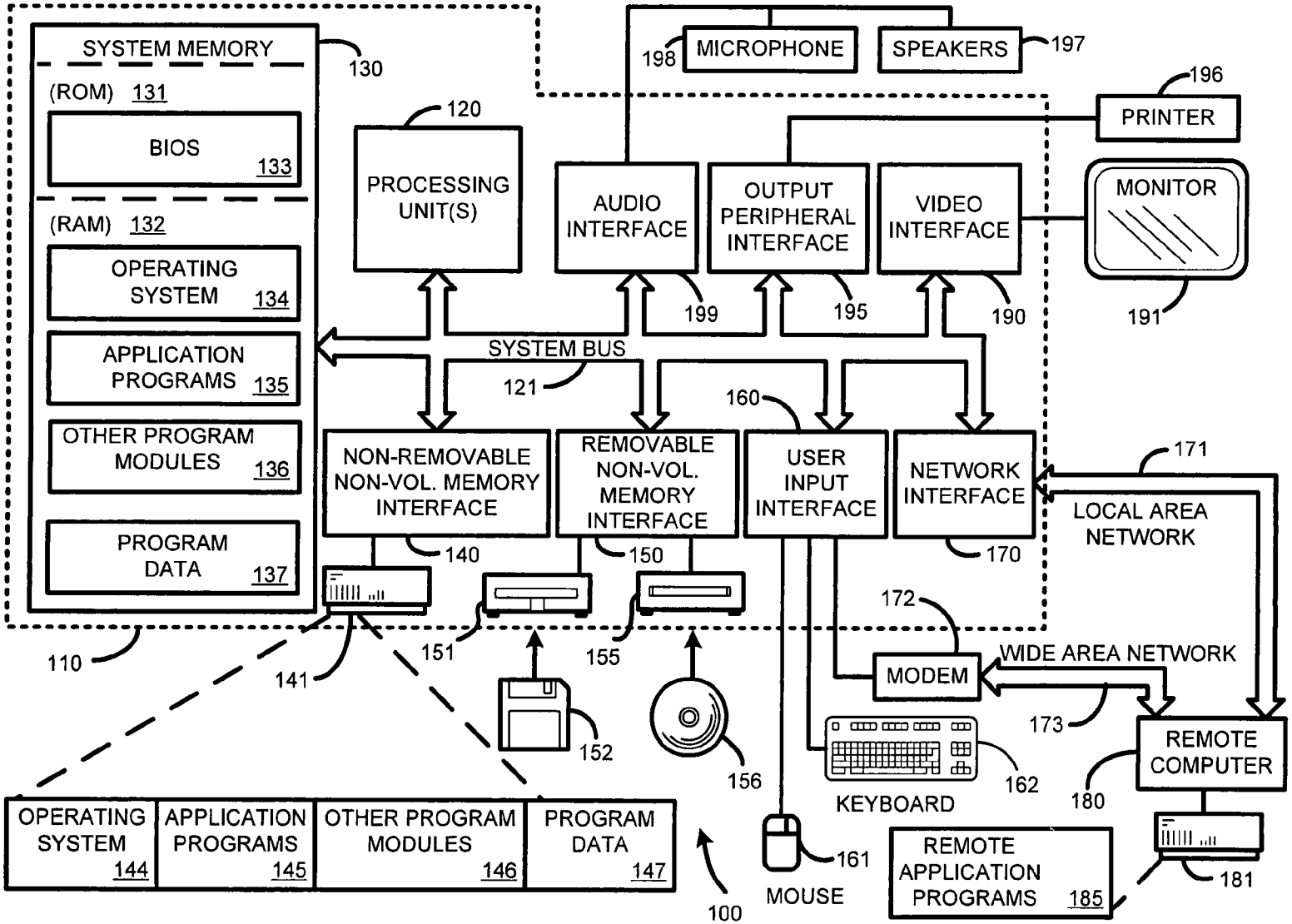
FIG. 1 is a general system diagram depicting a general-purpose computing device constituting an exemplary system for providing adaptive packet loss concealment for overlapped transform coded signals.

1.0 Exemplary Operating Environment:

FIG. 1 illustrates an example of a suitable computing system environment 100 on which the invention may be implemented. The computing system environment 100 is only one example of a suitable computing environment and is not intended to suggest any limitation as to the scope of use or functionality of the invention. Neither should the computing environment 100 be interpreted as having any dependency or requirement relating to any one or combination of components illustrated in the exemplary operating environment 100.

The invention is operational with numerous other general purpose or special purpose computing system environments or configurations. Examples of well known computing systems, environments, and/or configurations that may be suitable for use with the invention include, but are not limited to, personal computers, server computers, hand-held, laptop or mobile computer or communications devices such as cell phones and PDA's, multiprocessor systems, microprocessor-based systems, set top boxes, programmable consumer electronics, network PCs, minicomputers, mainframe computers, distributed computing environments that include any of the above systems or devices, and the like.

The invention may be described in the general context of computer-executable instructions, such as program modules, being executed by a computer. Generally, program modules include routines, programs, objects, components, data structures, etc., that perform particular tasks or implement particular abstract data types. The invention may also be practiced in distributed computing environments where tasks are performed by remote processing devices that are linked through a communications network. In a distributed computing environment, program modules may be located in both local and remote computer storage media including memory storage devices. With reference to FIG. 1, an exemplary system for implementing the invention includes a general-purpose computing device in the form of a computer 110.

Components of computer 110 may include, but are not limited to, a processing unit 120, a system memory 130, and a system bus 121 that couples various system components including the system memory to the processing unit 120. The system bus 121 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

Computer 110 typically includes a variety of computer readable media. Computer readable media can be any available media that can be accessed by computer 110 and includes both volatile and nonvolatile media, removable and non-removable media. By way of example, and not limitation, computer readable media may comprise computer storage media and communication media. Computer storage media includes volatile and nonvolatile removable and non-removable media implemented in any method or technology for storage of information such as computer readable instructions, data structures, program modules, or other data.

Computer storage media includes, but is not limited to, RAM, ROM, EEPROM, flash memory, or other memory technology; CD-ROM, digital versatile disks (DVD), or other optical disk storage; magnetic cassettes, magnetic tape, magnetic disk storage, or other magnetic storage devices; or any other medium which can be used to store the desired information and which can be accessed by computer 110. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared, and other wireless media. Combinations of any of the above should also be included within the scope of computer readable media.

The system memory 130 includes computer storage media in the form of volatile and/or nonvolatile memory such as read only memory (ROM) 131 and random access memory (RAM) 132. A basic input/output system 133 (BIOS), containing the basic routines that help to transfer information between elements within computer 110, such as during start-up, is typically stored in ROM 131. RAM 132 typically contains data and/or program modules that are immediately accessible to and/or presently being operated on by processing unit 120. By way of example, and not limitation, FIG. 1 illustrates operating system 134, application programs 135, other program modules 136, and program data 137.

The computer 110 may also include other removable/non-removable, volatile/nonvolatile computer storage media. By way of example only, FIG. 1 illustrates a hard disk drive 141 that reads from or writes to non-removable, nonvolatile magnetic media, a magnetic disk drive 151 that reads from or writes to a removable, nonvolatile magnetic disk 152, and an optical disk drive 155 that reads from or writes to a removable, nonvolatile optical disk 156 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 141 is typically connected to the system bus 121 through a non-removable memory interface such as interface 140, and magnetic disk drive 151 and optical disk drive 155 are typically connected to the system bus 121 by a removable memory interface, such as interface 150.

The drives and their associated computer storage media discussed above and illustrated in FIG. 1, provide storage of computer readable instructions, data structures, program modules and other data for the computer 110. In FIG. 1, for example, hard disk drive 141 is illustrated as storing operating system 144, application programs 145, other program modules 146, and program data 147. Note that these components can either be the same as or different from operating system 134, application programs 135, other program modules 136, and program data 137. Operating system 144, application programs 145, other program modules 146, and program data 147 are given different numbers here to illustrate that, at a minimum, they are different copies. A user may enter commands and information into the computer 110 through input devices such as a keyboard 162 and pointing device 161, commonly referred to as a mouse, trackball, or touch pad.

In addition, the computer 110 may also include a speech input device, such as a microphone 198 or a microphone array, as well as a loudspeaker 197 or other sound output device connected via an audio interface 199. Other input devices (not shown) may include a joystick, game pad, satellite dish, scanner, radio receiver, and a television or broadcast video receiver, or the like. These and other input devices are often connected to the processing unit 120 through a user input interface 160 that is coupled to the system bus 121, but may be connected by other interface and bus structures, such as, for example, a parallel port, game port, or a universal serial bus (USB). A monitor 191 or other type of display device is also connected to the system bus 121 via an interface, such as a video interface 190. In addition to the monitor, computers may also include other peripheral output devices such as a printer 196, which may be connected through an output peripheral interface 195.

The computer 110 may operate in a networked environment using logical connections to one or more remote computers, such as a remote computer 180. The remote computer 180 may be a personal computer, a server, a router, a network PC, a peer device, or other common network node, and typically includes many or all of the elements described above relative to the computer 110, although only a memory storage device 181 has been illustrated in FIG. 1. The logical connections depicted in FIG. 1 include a local area network (LAN) 171 and a wide area network (WAN) 173, but may also include other networks. Such networking environments are commonplace in offices, enterprise-wide computer networks, intranets, and the Internet.

When used in a LAN networking environment, the computer 110 is connected to the LAN 171 through a network interface or adapter 170. When used in a WAN networking environment, the computer 110 typically includes a modem 172 or other means for establishing communications over the WAN 173, such as the Internet. The modem 172, which may be internal or external, may be connected to the system bus 121 via the user input interface 160, or other appropriate mechanism. In a networked environment, program modules depicted relative to the computer 110, or portions thereof, may be stored in the remote memory storage device. By way of example, and not limitation, FIG. 1 illustrates remote application programs 185 as residing on memory device 181. It will be appreciated that the network connections shown are exemplary and other means of establishing a communications link between the computers may be used.

The exemplary operating environment having now been discussed, the remaining part of this description will be devoted to a discussion of the program modules and processes embodying an "adaptive packet loss concealer" for performing automatic reconstruction of lost data packets as a function of partial information available from neighboring data packets.

2.0 Introduction:

Real-time packet-based audio communications over conventional packet-based networks frequently results in the loss of one or more packets during any given communication session. The real-time nature of such communications precludes retransmission of those lost packets due to the unacceptable delays that would result. Consequently, packet loss concealment methods are employed to "hide" lost packets from the listener. Unfortunately, conventional loss concealment methods, such as packet repetition or stretch/overlap methods, do not fully exploit information available from partially received samples.

To address this problem, the adaptive packet loss concealer identifies an optimized packet loss concealment solution for maximizing the quality of recovered signals. This solution is determined as a function of received neighboring data packets by solving an underdetermined system of linear equations representing partially received samples while minimizing a computed error based on a model of the signal obtained from neighboring blocks or frames received by the decoder.

Further, the packet loss concealment techniques described herein are fully adaptable for use in combination with conventional jitter control, signal stretching or compression, and other signal buffering techniques. Note that jitter control, signal stretching and compression, and other signal buffering techniques, and their operation in combination with packet loss concealment techniques, are well known to those skilled in the art, and will not be described in detail herein. In addition, the packet loss concealment techniques described herein are also adaptable for use with essentially any linear transform where some of the coefficients are missing. Important cases include missing "frames" of overlapped transform (e.g., MLT), or wavelets, or even single or multiple missing transform coefficients within a block of block transform (e.g., DCT). However, for purposes of explanation, the discussion of the packet loss concealer provided herein will focus on the case of overlapped transforms.

Overlapped transform coders, such as transforms with fixed length basis (e.g., modulated lapped transforms (MLT's)), and transforms having variable length basis (e.g., wavelets) are used in numerous codecs, including audio (MP3, WMA), speech (ITU-G722.1), image (JPEG2000), and also in some video codecs. As is well known to those skilled in the art, the overlapping blocks of an overlapped transform coded signal contain partial information about neighboring blocks as a result of the use of overlapping sampling windows. Consequently, the coded blocks of a received data packet will contain partial information regarding the coded blocks in each immediately neighboring packet (preceding and succeeding). The packet loss concealer described herein uses this partial information in determining adaptive solutions for concealing missing blocks in applications such as, for example, real time audio communication over packet networks.

When transmitting encoded signal packets across conventional packet-based networks, it is common that one or more of the transmitted packets are lost, or overly delayed, during any given communication session. The real-time nature of such communications precludes retransmission of those lost packets due to the unacceptable delays that would result. Typically, packets are declared as being lost when they are not received within a predetermined window of time. Note that this window of time may be variable depending upon whether jitter control or buffered playback techniques are also being used in combination with the packet loss concealment methods described herein. In any case, once it is determined that loss concealment should be used to hide a particular lost packet, the packet loss concealer described herein operates to reconstruct optimized signal segments for concealing the lost packet.

2.1 System Overview:

As is well understood by those skilled in the art, packet loss concealment is typically used to hide or minimize artifacts that will result from either joining non-contiguous segments of a decoded signal, or from blending new samples into the existing content of a decoded signal for the purpose of filling any "holes" left in the signal as a result of packet loss or undue delay.

In general, the adaptive packet loss concealer operates to "hide" lost packets from the listener by exploiting information available from partially received samples to reconstruct missing signal segments. The adaptive packet loss concealer provides this capability by determining an optimized packet loss concealment solution for particular lost packets. This optimized solution is found by solving an underdetermined system of linear equations representing partially received samples while minimizing a computed error based on a model of the signal obtained from neighboring blocks or frames received by the decoder.

In particular, as is known to those skilled in the art, when coding a signal using 2-times overlapped transforms, the signal is split into overlapping blocks of 2N samples. Then, for each block, N transform coefficients are obtained via a multiply/accumulate process with the basis functions constituting the transform. On the decoder side, the basis functions are scaled by the transform coefficients, and overlap/added to reconstruct "partial" blocks of 2N samples each. These blocks of samples are then overlap/added to reconstruct the original signal for playback, or other use, as desired.

However, if the information about any one of the blocks of N coefficients is lost, a total of 2N samples—spanning the lost coefficients—cannot be reconstructed. Some conventional systems operate to replace the lost coefficients are with zeros, resulting in the generation of a non-zero, but incorrect reconstructed signal. Other systems, e.g., the error concealment method recommended by the ITU G722.1 standard, simply repeat the previous frame of data. Unfortunately, the result is typically that there are noticeable artifacts in such reconstructed signals.

In order to address this and other problems, the adaptive packet loss concealer makes use of the observation that overlapped transforms, such as conventional modulated lapped transforms (MLT), are critically sampled. Therefore, some partial information is available in immediately neighboring blocks about the 2N incomplete samples resulting from a lost block of N coefficients. Furthermore, the adaptive packet loss concealer first uses this partial information or other neighboring available signal to construct an energy-based model of the surrounding components of the signal. Next, the adaptive packet loss concealer operates to construct a total of N linear equations from neighboring blocks for describing the 2N incomplete samples. These N linear equations represent an undetermined system of equations (N equations and 2N variables).

The adaptive packet loss concealer then operates to find and choose an optimal solution to this underdetermined system of equations by finding a solution, among all possible solutions, that minimizes a model-based energy criterion relative to the constructed energy-based model of the surrounding signal. Finally, the lost block of 2N samples is reconstructed using the energy-based optimal solution, and the corresponding samples are provided for playback to hide the loss of the original coefficients. Further, it should be noted that as a result of the windowing used in obtaining the original coefficients when encoding the original signal, the ends of the reconstructed signal segment will align exactly with the ends of the adjoining signal segments that were successfully received by the system. Consequently, additional smoothing or alignment of the reconstructed signal is not necessary.

Figure 2:
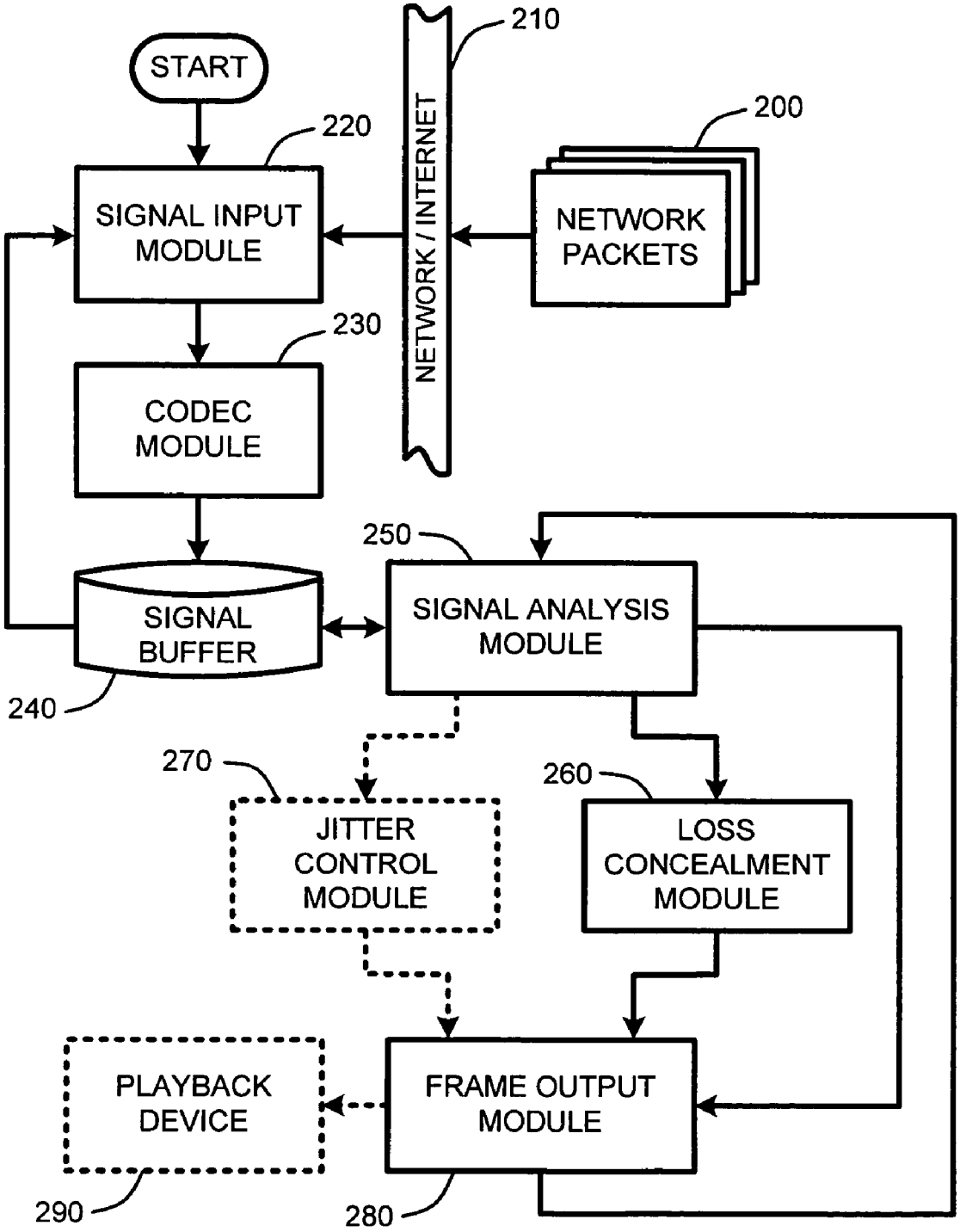
FIG. 2 illustrates an exemplary architectural diagram showing exemplary program modules for implementing a system which provides adaptive packet loss concealment for overlapped transform coded signals.

2.2 System Architecture:

The processes summarized above are illustrated by the general system diagram of FIG. 2. In particular, the system diagram of FIG. 2 illustrates the interrelationships between program modules for implementing an adaptive packet loss concealer for reconstructing optimized signal segments for concealing the lost packets. It should be noted that any boxes and interconnections between boxes that are represented by broken or dashed lines in FIG. 2 represent alternate embodiments of the packet loss concealer described herein, and that any or all of these alternate embodiments, as described below, may be used in combination with other alternate embodiments that are described throughout this document.

As illustrated by FIG. 2, a system and method for adaptive packet loss concealment begins by receiving a stream of network packets 200 across a packet-based network 210. These packets 200 are received by a signal input module 220. This signal input module 220 then provides the received packets to a codec module 230 which uses the appropriate conventional decoder to decode the received packets 200 into one or more signal frames. In one embodiment, these decoded signal frames are then stored in a conventional signal buffer 240 as soon as they have been decoded. This process for receiving network packets 200 via the signal input module 220, decoding those packets 230, and storing the packets into the signal buffer 240 continues for as long as receipt of network packets 200 continues. Note that while the following discussion assumes the use of the signal buffer 240, the use of a signal buffer is an optional component of the system and method described herein, and is included in the following discussion because such buffers are commonly used in packet network communications systems.

Assuming the use of the signal buffer 240, the signal buffer will not continue to be filled indefinitely. In fact, frames are read out of the buffer, on an as-needed basis, but as quickly as possible so as to minimize buffer delay. However, rather then simply read the frames out of the buffer 230 for playback, a signal analysis module 250 is used to examine the contents of the buffer 240 for the purpose of determining whether to provide unmodified playback from the buffer contents or whether to provide for packet loss concealment for overly delayed or lost packets via a loss concealment module 260. In one embodiment, the signal analysis module 250 also determines whether to apply conventional jitter control techniques to one or more of the buffered signal frames via a conventional jitter control module 270.

The contents of the buffer 240, whether or not modified via ether the loss concealment module 260 or the jitter control module 270 are then gradually output by a frame output module 280 for playback on a conventional playback device 290. Besides standard computers, such playback devices also include wired and wireless telephones, cellular telephones, radio devices, and other packet-based communications systems or devices operable over a packet-based network.

In general, the determination of how to process the frames in the signal buffer 240 is a function of buffer content. For example, where the buffer 240 is full or nearly full, and there are no missing frames, each desired output frame is simply provided directly from the signal buffer 230 to the frame output module 280 for playback on the playback device 290. In the case where one or more packets are declared to be a late loss, the loss concealment module 260 is used to reconstruct the lost packets as a function of the partial information available from neighboring packets.

Finally, as noted above, conventional jitter control techniques, including buffer flow control and stretching and compression of signal frames in the signal buffer, may also be applied to complement the packet loss concealment techniques described herein. Note that the use of conventional jitter control techniques in combination with packet loss concealment techniques is a concept that is well understood by those skilled in the art. Consequently, the use of such techniques in combination with the packet loss concealment methods provided herein control will not be discussed in specific detail.

3.0 Operation Overview:

The above-described program modules are employed in the adaptive packet loss concealer. As summarized above, this adaptive packet loss concealer operates to optimize reconstruction of lost data blocks as a function of the information contained within immediately neighboring data blocks that have been received. Conventionally, packet losses are declared under any of several conditions, including being declared as a "late loss" when it is not received within a predetermined period of time, or when a subsequent packet is received prior to receiving the next expected packet in the transmission. In any case, once a packet is declared lost, the packet loss concealer then operates to conceal that loss as described in detail in the following sections.

In general, the adaptive packet loss concealer operates by first using a conventional overlapped transform-based codec for decoding and reading transmitted signal frames into a signal buffer as soon as all information necessary to decode those frames have been received. For some codecs, this "necessary information" may include previous packets, as long as they have not yet been declared as "losses." Samples of the decoded audio signal are then played out of the buffer according to the needs of the player device. Note that the size of the input frame read into the buffer and the size of the output frame (i.e., the sample output to the player device) do not need to be the same. Input frame size is determined by the codec, and some codecs use larger frame sizes to save on bitrate. Output frame size is generally determined by the buffering system on the playout or playback device.

Further, as noted above, the packet loss concealment processes described herein are compatible with most conventional overlapped transform codecs for decoding and providing a playback of audio signals. In fact, in view of the detailed discussion provided herein, it should be clear to those skilled in the art that the packet loss concealment techniques described herein are adaptable for use with essentially any linear transform where some of the coefficients are missing. However, as noted above, for purposes of explanation, the discussion of the packet loss concealer provided herein will focus on the case of overlapped transforms. The following sections provide a detailed operational discussion of exemplary methods for implementing the program modules provided above in Section 2.

3.1 Packet Loss Concealment:

As noted above, the adaptive packet loss concealer operates to hide lost packets by determining an optimized packet loss concealment solution for particular lost packets as a function of the partial information regarding the incomplete samples that is inherently available in the immediately preceding and succeeding neighboring packets to the lost packet. As noted above, the packet loss concealer is operable with virtually any linear transform. However, for purposes of explanation, the packet loss concealer will be described below in the context of a particular overlapped transform, such as the MLT used in the well known "Siren Codec."

In particular, the conventional "Siren Codec" (ITU-T G.722.1 codec), currently used in Windows Messenger™ is based on the well known Modulated Lapped Transform (MLT). The only state information is 320 partial samples that overlap between adjacent frames. In particular, Siren frames are 20 ms (320 samples) each, with each Siren frame containing transform coefficients corresponding to a 640 point MLT. Subsequent frames are then overlapped by 320 samples and added. Therefore, if a single frame is missing as a result of a lost packet, a total of 40 ms of the signal will be incomplete. Consequently, to address this problem, the partial information in the surrounding frames is used by the adaptive packet loss concealer to reconstruct the lost samples.

For example, because of the way in which the MLT is computed using overlapping decaying windows which sum to 1, the leading and trailing half of each surrounding segment is increasingly dominated by the signal that is to be estimated for loss concealment, with the samples increasing in accuracy towards the ends closest to the missing frame. Specifically, as is known to those skilled in the art of MLT computations with respect to the G.722.1 codec:

"The MLT can be decomposed into a window overlap and add operation, followed by a type IV Discrete Cosine Transform (DCT). The window, overlap and add operation is given by:

$$v(n)=w(159-n)x(159-n)+w(160+n)x(160+n),\ \text{for}\ 0\leqq n\leqq 159$$

$$v(n+160)=w(319-n)x(320+n)-w(n)x(639-n),\ \text{for}\ 0\leqq n\leqq 159$$

where:

$$w(n)=\sin((pi/640)(n+0.5)),\ \text{for}\ 0\leqq n\leqq 320\text{"}$$

Consequently, if at the decoder side, the inverse DCT is performed, but the overlap/add operation is not, the signal v[0:319], as defined above, will be recovered. Further, note that v[0:159] is increasingly dominated by x[160:319]. For example, v[159]=0.0025x[0]+0.999997x[319]. Consequently, it should be clear that v[159] can be used as an approximation for x[319]. Obviously, the further from the center of v, the worse the approximation is. However, this partial information is useful in finding the optimized solution to the aforementioned undetermined system of linear equations.

In particular, the optimized solution is found by solving an underdetermined system of linear equations representing the partially received samples while minimizing a computed error based on a model of the signal obtained from neighboring blocks or frames received by the decoder. For example, assume the underdetermined system of equation is generally given the following equation:

$$z>FJx \qquad \text{Equation (1)}$$

where F is a N×2N fold-over matrix as illustrated by Equation (2):

$$F>\begin{bmatrix} 0 & 0 & & 1 & 1 & & 0 & 0 & 0 & 0 & \dots & 0 & 0 & \dots & 0 & 0 \\ \vdots & & \iddots & & & \ddots & & \vdots & \vdots & \vdots & & \vdots & \vdots & & \vdots & \vdots \\ 0 & 1 & & 0 & 0 & & 1 & 0 & 0 & 0 & \dots & 0 & 0 & \dots & 0 & 0 \\ 1 & 0 & \dots & 0 & 0 & \dots & 0 & 1 & 0 & 0 & \dots & 0 & 0 & \dots & 0 & 0 \\ 0 & 0 & \dots & 0 & 0 & \dots & 0 & 0 & 1 & 0 & \dots & 0 & 0 & \dots & 0 & \grave{a}1 \\ 0 & 0 & \cdots & 0 & 0 & \dots & 0 & 0 & 0 & 1 & & 0 & 0 & & \grave{a}1 & 0 \\ \vdots & \vdots & & \vdots & \vdots & & \vdots & \vdots & \vdots & & \ddots & & & \iddots & & \vdots \\ 0 & 0 & \dots & 0 & 0 & \dots & 0 & 0 & 0 & 0 & & 1 & \grave{a}1 & & 0 & 0 \end{bmatrix}, \qquad \text{Equation (2)}$$

and where J is a 2N×2N diagonal matrix with windowing coefficients that decay to zero. Typically, windowing coefficients will decay to zero (with the overlap summing to one). For example, for the siren codec, the windowing matrix coefficients are as indicated by Equation (3):

$$J_{ij} > \begin{cases} \sin\left(\frac{\pi}{2N}(i, .5)\right), & \text{if } i > j \\ 0 & \text{otherwise} \end{cases} \qquad \text{Equation (3)}$$

Finally, x is a 2N×1 vector which represents the incomplete or lost samples resulting from the packet loss, and z is a N×1 vector derived from the neighboring transform coefficients (which are assumed to not have been lost). Depending upon the type of overlapped transform used to encode the signal, this vector can be derived by applying the inverse DCT to the received coefficients, and taking the corresponding half vector of the results (depending on whether the neighboring frame being used is the immediately preceding or immediately succeeding frame to the lost frame, as discussed in further detail below.

One embodiment for solving the underdetermined system in Equation (1) is to solve for the minimum energy vector x based on the Moore-Penrose generalized inverse of (FJ). This technique provides a minimum energy signal segment x that satisfies the received (partial) information. Unfortunately, simulations of this embodiment have shown that this is not a particularly good choice for x, as the nature of the matrix J tends to concentrate the energy in the higher gain samples.

An alternate embodiment operates to provide a better solution by instead minimizing the windowed signal Jx. This embodiment operates to more evenly distribute the signal energy across the samples of x. Unfortunately, this embodiment fails to fully use the partial information available in the neighboring frames.

Therefore, to address this particular point, Equation (1) is amended to introduce a pseudo identity matrix I to produce another embodiment which provides superior signal reconstruction results as a function of the partial information available in the neighboring frames. In particular, as illustrated by Equation (4), introducing the identity matrix I in Equation (1) results in Equation (4):

$$z=FJIx \qquad \text{Equation (4)}$$

However, rather than interpreting I as a simple identity matrix, it is actually interpreted as a basis for the space of x. In this context, the basis consists simply of impulses.

3.1.1 Processing in the LPC Residual Domain:

As is known to those skilled in the art, a time-domain signal can always be decomposed into a spectral envelope, or (Linear Predictive Coding) LPC spectrum that represents a frame-level spectrum, and an LPC residual that represents short time information such as small details in the signal spectrum. In the context of the adaptive packet loss concealer described herein, the LPC residual is used for choosing a solution that results in the synthesized or reconstructed signal segment having an LPC spectrum similar to the LPC spectra of the neighboring frames. In other words, the LPC spectra of the neighboring frames are used as models in reconstructing the lost frames. Further, in the case of a packet-based voice communications system, the LPC residual is also used to introduce periodicity which accounts for the pitch characteristics of voiced speech.

Note that for the purposes of explanation, the following example assumes that in reconstructing a particular lost frame, only the preceding frame is available. However, it should be understood that ideally, both the preceding and succeeding frames, and the corresponding partial information regarding the lost frame, is available for use in optimally reconstructing the lost frame. The use of subsequent frames, either in place of, or in combination with, the preceding frame should be obvious to those skilled in the art in view of the following example.

In particular, in this example, LPC filter coefficients are first computed for the frame preceding the incomplete segment. The signal is then extrapolated by the LPC filter into the incomplete segment. The corresponding influence of this residual signal is then computed and subtracted from z, i.e., a new system is defined by:

$$z \text{ å } FJIx_0 > FJIx^* \qquad \text{Equation (5)}$$

where $x_0$ is the no-excitation response for the LPC filter with initial states given by the previous (complete) frame, and $x^*=x-x_0$.

Next, in view of the interpretation of I as a basis function for the vector x (now x*), rather than minimizing the energy of x, the energy of the representation of x with a basis function having a spectrum corresponding to the desired LPC spectrum is instead minimized. In order to accomplish this, the LPC filter is applied to the identity matrix I, to obtain a new basis L, where each column of L corresponds to the impulse response of the LPC filter which models the neighboring frame. In other words, assuming the use of the Siren Codec discussed above, there will be 640 possible solutions representing the missing 320 samples of the lost frame, with each possible solution represented by an impulse that is spread into a wave form having the same LPC spectrum as the preceding (and/or succeeding) segment of the signal.

Finally, in a closely related embodiment, to further improve the resulting reconstructed signal, the pitch and periodicity of the reconstructed segment is made to correspond with that of the surrounding signal segments. In particular, an estimate of the periodicity and pitch period for the segment to be reconstructed is computed, again as a function of the neighboring frame or frames, and applied to the basis function L. Note that given this information from both preceding and succeeding segments, various embodiments use an average of the periodicity and pitch of the received segments, or a windowed decay from the preceding to the succeeding segment so as to better match the periodicity and pitch of the reconstructed segment to the surrounding frames.

As a result of the periodicity and pitch matching, each column of L will represent a series of "colored" pulses, each apart by the pitch period, each with the impulse response of the LPC filter, and each with decreasing amplitude, based on the estimated periodicity index. Note the level of the decreasing amplitude of the impulses corresponds to a gain function computed via the autocorrelation of segments surrounding the lost segment. For example, given a "gain" of 0.7, the first impulse would be scaled to 1.0, the second to 0.7, the third to 0.49, etc. In the following notation, this final basis matrix is referred to as L*. The representation of this new basis is not x anymore, so instead, this representation is referred to as r, resulting in the following equation:

$$z \text{ å } FJIx_0 > FJL^*r \qquad \text{Equation (6)}$$

Equation (6) is then solved for r using the pseudo-inverse of (FJL*), as illustrated by Equation (7):

$$r=(FJL^*)^{\dagger}(z-FJIx_0) \qquad \text{Equation (7)}$$

Note that this solution is the one that minimizes the LPC residual error of x, as is desired. Therefore, the final solution for x is then obtained by simply computing:

$$x>L^*r, x_0 \quad \text{Equation (8)}$$

x is then used to replace the lost signal segment.

3.1.2 Consecutive Missing Frames:

It should be noted that in the case of two or more consecutive missing frames, while any neighboring received frames will contain partial information about the edges of the missing signal segment, those neighboring frames will not contain any information regarding a section in the center of the missing segment. Consequently, while the edges of such missing segments can be reconstructed, the center of such missing segments cannot be reconstructed using the techniques described herein. Therefore, in such cases, conventional packet loss concealment techniques are used in combination with the techniques described herein to fill the portion of the missing segment that can not be reconstructed from the partial information.

3.2 Process Operation:

As noted above, the program modules described in Section 2.0 with reference to FIG. 2 are employed to reconstruct lost signal segments resulting from the loss of data packets. This process is further depicted in the flow diagram of FIG. 3. It should be noted that the boxes and interconnections between boxes that are represented by broken or dashed lines in FIG. 3 represent alternate embodiments of the present invention, and that any or all of these alternate embodiments, as described below, may be used in combination.

Figure 3:
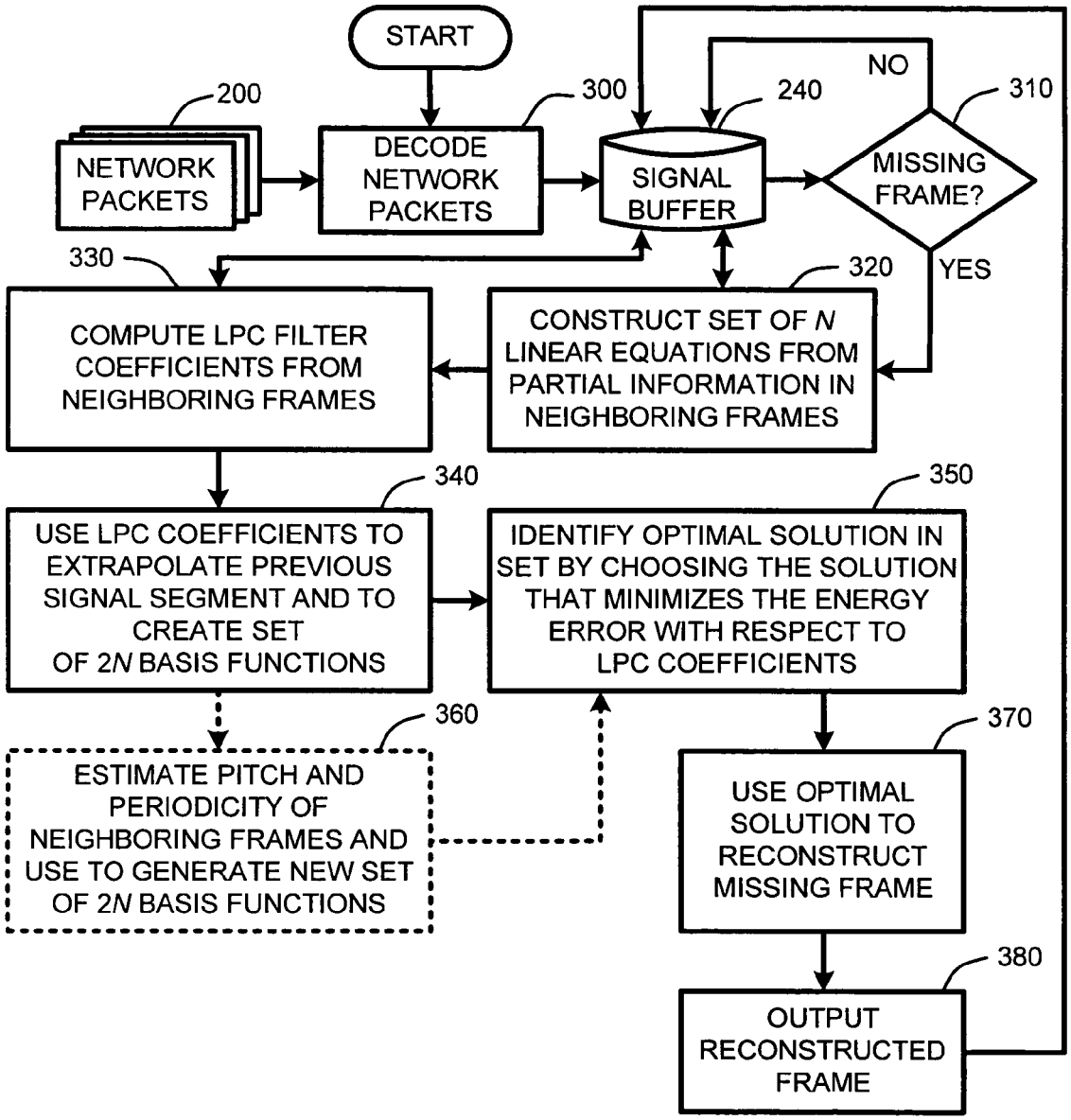
FIG. 3 illustrates an exemplary system flow diagram for providing adaptive packet loss concealment for overlapped transform coded signals.

Referring now to FIG. 3 in combination with FIG. 2, and in view of the discussion provided above, the operation of the adaptive packet loss concealer begins by decoding 300 network packets 200 and placing the decoded frames into the signal buffer 240. A determination is made 310 as to whether there are any missing frames.

If a frame is missing, then a set of N linear equations is constructed 320 from the partial information available in the neighboring frames (i.e., either or both the immediately preceding and succeeding neighbors of the missing frame). In addition, the neighboring frames are modeled in the LPC domain by computing 330 LPC filter coefficients from the neighboring frames.

These computed LPC coefficients are then used to extrapolate the previous segment into the missing segment. This is done by obtaining the "no-excitation response" of the LPC filter with initial states given by the last few samples of the preceding segment. The contribution of this "no-excitation response" is then subtracted from the partial information available for the 2N samples. Furthermore, a set of 2N independent signals is synthesized by running impulses at each of the 2N positions through the LPC filter. Note that if a fixed LPC filter is used, each signal in this set of 2N independent signals will simply be the impulse response of the LPC filter, each with a 1-sample shift from the previous one. These 2N independent signals are referred to as "basis functions" (340). This basis is then used to compute 350 the solution to the set of undetermined linear equations constructed in step 320 by finding the solution which minimizes the energy.

However, as noted above, in one embodiment, even better results are achieved by first modifying the set of 2N basis functions to more closely conform to the estimated 360 pitch and periodicity of the signal segment, or segments, neighboring the missing segment. Given these modified 2N basis functions, the one optimal solution is identified 350 by finding the solution which minimizes the energy over the coefficients on this set of basis functions, as noted above.

Finally, this single optimal solution is used to reconstruct 370 the missing frame. This reconstructed frame is then output 380 to the signal buffer 240 where it is inserted to fill the gap where the corresponding missing frame exists, so as to hide the loss of that data during any subsequent playback of the signal.

The foregoing description of the adaptive packet loss concealer has been presented for the purposes of illustration and description. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. Clearly, many modifications and variations are possible in light of the above teaching. Finally, it should be noted that any or all of the aforementioned embodiments may be used in any combination desired to form additional hybrid embodiments of the adaptive packet loss concealer described herein.

What is claimed is:

1. A method for concealing missing coefficients of a transform of a signal by reconstructing blocks of samples of sample of the signal corresponding to the missing coefficients, comprising steps for:

extracting a set of coefficients from frames of the transform of the signal;

determining which coefficients are missing;

locating an under-determined block of samples of the signal corresponding to at least one missing coefficient;

constructing from a subset of the extracted coefficients a set of linear equations representing partial constraints on the under-determined block of samples;

modeling samples of the signal neighboring the under-determined block of samples to construct a basis for the under-determined block of samples;

optimizing the coefficients of the under-determined block of samples with respect to the constructed basis and the partial constraints; and reconstructing a block of samples corresponding to the missing coefficients from the optimized coefficients with respect to the basis.

2. The method of claim 1, where the missing coefficients correspond to an entire frame of coefficients in an overlapped transform coded signal.

3. The method of claim 1 wherein modeling samples of the signal comprise steps for computing Linear Predictive Coding (LPC) filter coefficients for the neighboring samples, and wherein constructing the basis comprises steps for constructing a set of impulse responses of an LPC filter estimated from the computed LPC filter coefficients.

4. The method of claim 3 wherein the impulse responses are approximately periodic with a period approximately matching a pitch period estimated from the neighboring samples.

5. The method of claim 1 wherein optimizing the coefficients comprises steps for minimizing an energy of the coefficients with respect to the constructed basis and the partial constraints.

6. The method of claim 5 wherein minimizing the energy comprises steps for computing a pseudo-inverse with respect to the constructed basis and the partial constraints.

7. The method of claim 1 further comprising steps for maintaining a minimum signal buffer content during a real-time decoding and playback of frames from the signal buffer by using signal jitter control for any of stretching and compressing decoded signal frames.

8. A computer-readable medium having computer executable instructions for, concealing missing frames of coefficients of an overlapped transform of a signal by reconstructing blocks of samples of the signal corresponding to the missing frames of coefficients, said computer executable instructions comprising:

determining which frames are missing from a set of received frames of the overlapped transform of the signal;

locating an under-determined block of samples of the signal corresponding to a missing frame;

extracting coefficients from at least one received frame;

constructing from the extracted coefficients a set of linear equations representing partial constraints on the under-determined block of samples;

modeling samples of the signal neighboring the under-determined block of samples;

constructing from the modeled samples a basis for the under-determined block of samples;

optimizing the coefficients of the under-determined block of samples with respect to the constructed basis and the partial constraints; and reconstructing a block of samples corresponding to the missing frame from the optimized coefficients with respect to the basis.

9. The computer-readable medium of claim 8 wherein modeling the samples is performed in the Linear Predictive Coding (LPC) domain by computing LPC filter coefficients for the neighboring samples, and the basis is constructed as a set of impulse responses of an LPC filter estimated from the computed LPC filter.

10. The computer-readable medium of claim 9 wherein the impulses are approximately periodic with period approximately matching a pitch period estimated from the neighboring samples.

11. The computer-readable medium of claim 8 wherein optimizing the coefficients comprises minimizing an energy of the coefficients with respect to the constructed basis and the partial constraints.

12. The computer-readable medium of claim 11 wherein minimizing the energy comprises performing a pseudo-inverse.

13. The computer-readable medium of claim 8 wherein the signal is an audio signal.

14. A method for reconstructing one or more missing data frames of an overlapped transform coded signal by reconstructing one or more of the missing data frames, comprising:

storing received data frames of the coded signal to a signal buffer;

determining whether any data frames are of the data frames are missing;

constructing a set of under-determined linear equations from partial information extracted from at least one of a preceding neighboring frame and a succeeding neighboring frame, relative to a missing frame;

modeling the at least one neighboring frame and using the at least one modeled neighboring frame for generating a basis for the missing frame;

identifying an optimal solution to the set of under-determined linear equations as a function of the generated basis;

reconstructing the missing frame from the identified optimal solution; and inserting the reconstructed missing frame into its proper position between corresponding neighboring frames in the signal buffer.

15. The method of claim 14 wherein modeling the at least one neighboring frame further comprises modeling the at least one neighboring frames in the Linear Predictive Coding (LPC) domain by computing LPC filter coefficients for the neighboring frames.

16. The method of claim 15 wherein generating the basis for the missing frame further comprises extrapolating the at least one neighboring frames into the missing frame by obtaining no-excitation responses of the computed LPC filter coefficients to construct a set of basis functions for the missing frame from the LPC filter coefficients.

17. The method of claim 14 wherein identifying the optimal solution to the set of under-determined linear equations comprises choosing a linear equation that minimizes an energy error computed from the basis.

18. The method of claim 14 further comprising modifying the basis to approximately conform to an estimated pitch and periodicity computed from the at least one neighboring data frames.

19. The method of claim 18 wherein estimating the pitch and periodicity further comprises any of:

computing an average of the periodicity and pitch of the at least one neighboring data frames; and computing a windowed decay of the pitch and periodicity from the preceding neighboring data frame into the missing data frame.

20. The method of claim 14, where boundary continuity between the reconstructed missing frame and the neighboring frames is assured by computing a signal extrapolation of at least one of the neighboring frames into the missing frame beforehand, and subtracting the influence of the signal extrapolation from the missing frame.

* * * * *